United States Patent [19]

Perreira

[11] 4,089,551

[45] May 16, 1978

[54] QUICK-RELEASE GAS CAP LATCH RETAINER DEVICE

[76] Inventor: Walter Perreira, 966 West St., Hollister, Calif. 95023

[21] Appl. No.: 774,129

[22] Filed: Mar. 3, 1977

[51] Int. Cl.[2] ..... E05C 19/18

[52] U.S. Cl. ..... 292/260; 292/258; 292/246

[58] Field of Search ..... 292/260, 336.3, 258, 292/288, 257, 246

[56] References Cited

U.S. PATENT DOCUMENTS

| | | | |
|---|---|---|---|
| 116,684 | 7/1871 | Cone | 292/257 |
| 988,796 | 4/1911 | Mandeville | 292/257 X |
| 1,067,717 | 7/1913 | Campbell | 292/260 |
| 2,089,251 | 8/1937 | DeFrees | 292/257 X |

FOREIGN PATENT DOCUMENTS

| | | | |
|---|---|---|---|
| 846,206 | 8/1952 | Germany | 292/247 |

*Primary Examiner*—Richard E. Moore

*Attorney, Agent, or Firm*—Boone, Schatzel, Hamrick & Knudsen

[57] ABSTRACT

A latch retainer device for preventing the accidental opening of a quick-release gas cap and including a clip for fitting over and engaging the gas cap hinge, a loop for fitting over and engaging the gas cap release handle, a stud attached to the loop and passing through a hole in the clip, and a wing nut threaded onto the stud for securing the release handle in its locked position.

4 Claims, 2 Drawing Figures

QUICK-RELEASE GAS CAP LATCH RETAINER DEVICE

BACKGROUND OF THE INVENTION

1. Field of the Invention

The present invention relates generally to locking devices for container closure apparatus, and more particularly, to a latch retainer device for quick-release, gasoline container caps.

2. Description of the Prior Art

Quick-release gasoline caps are commonly used for auxiliary gasoline tanks and for caps on oil and gasoline filler tubes on racing and sports type vehicles. Such caps are not only easier to fill but are more stylish than conventional type gasoline caps. They, however, suffer from the always present danger that the cap latching mechanism may inadvertently release due to vibration, a foreign object striking the cap or because of impact, and allow spillage of the gasoline from the container which may result in an explosion or fire. Such dangers have therefore prompted various agencies to limit the use of quick-release gas caps.

SUMMARY OF THE PRESENT INVENTION

It is therefore an object of the present invention to provide a latching device that will secure a quick-release gasoline cap and prevent accidental openings thereof.

Briefly, the preferred embodiment of the present invention includes a clip adapted to fit over the gas cap hinge mechanism, a loop adapted to fit over the gas cap release handle, a stud attached to the loop and passing through a hole in the clip, and a wing nut threaded onto the stud for drawing the loop toward the clip to secure the release handle in its locked position.

This and other objects of the present invention will no doubt become apparent to those skilled in the art after having read the following detailed description of the preferred embodiment which is illustrated in the several figures of the drawing.

IN THE DRAWING

FIG. 1 is a perspective view showing a quick-release gas cap latch retainer device in accordance with the present invention; and FIG. 2 is a side elevation illustrating the latch retainer device shown in FIG. 1 installed on a quick-release gas cap.

DETAILED DESCRIPTION OF THE PREFERRED EMBODIMENT

Figure 1:
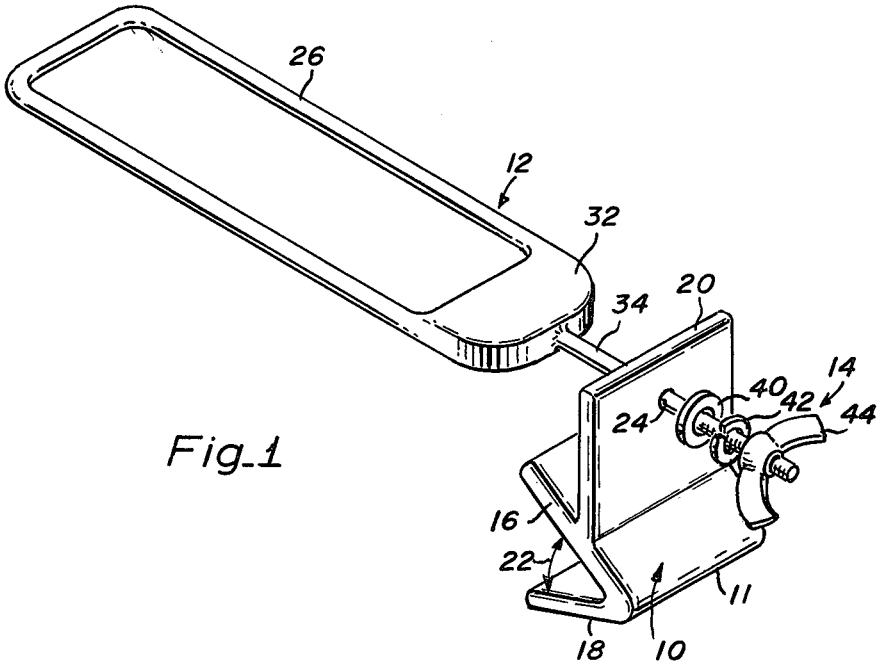

Referring now to the drawing, a quick-release gas cap latch retainer device in accordance with the present invention is illustrated in FIG. 1. The device generally includes a clip-like member 10, a latch handle engaging body 12, and locking hardware 14. Clip 10 is comprised of three equal-width flat rectangular sections 16, 18, and 20, with sections 16 and 18 of which intersect at 11 to form an acute angle 22. The third section 20 intersects section 16 near the middle thereof and is disposed within a plane substantially perpendicular to a second plane bisecting acute angle 22. A hole 24 (more clearly shown in FIG. 2) is provided along a line vertically bisecting the width of section 20 and lying near the edge opposite the juncture of section 16 and 20.

Body 12 is comprised of a generally U-shaped member 26 formed of rod stock, a flat D-shaped section 32, and a threaded stud 34. U-shaped member 26 and D-shaped section 32 form a nearly rectangular loop. The inside dimensions of the loop are designed to permit the loop to be inserted over a gas cap release handle as will be described below. The dimensions of the loop are chosen to be large enough to receive one end of the handle.

The threaded stud 34 projects from the center of the rounded side of D-shaped section 32 in a direction away from the rectangular loop, and coincides with the major axis of the rectangle. Stud 34 is of such diameter as to pass through hole 24.

Locking hardware 14 includes a flat washer 40, a locking washer 42 and a wing nut 44. Washers 40 and 42 are designed to fit over stud 34, and wing nut 44 is designed to thread onto stud 34 to draw it through hole 24.

Figure 2:
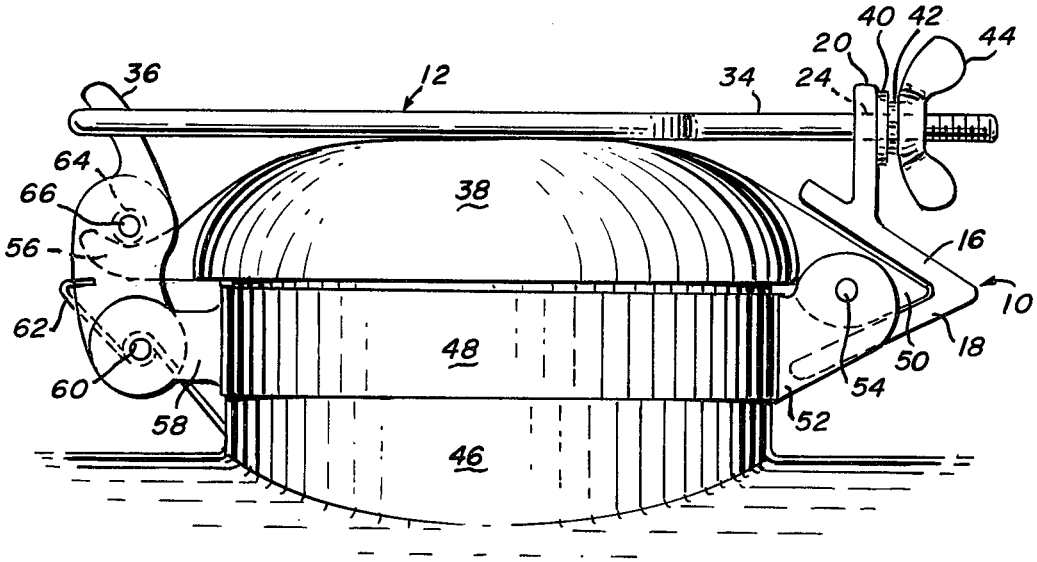

Referring now to FIG. 2, the latch retainer device is shown securing a typical quick-release type gas cap 38 in its latched position. In a typical case, the gas cap 38 is secured to a filler neck 46 by a mounting collar 48. More specifically, a solid hinge member 50, formed on one side of gas cap 38 is positioned between and is rotatably secured by a suitable pin 54 to two tabs 52 which are attached to mounting collar 48. This allows gas cap 38 to be pivoted open for filling the gas tank and closed against the rim of neck 46 to prevent spillage of the gasoline.

Gas cap 38 is normally held in the closed position by the action of release handle 36 overriding a tang 56 formed on the side of gas cap 38 opposite hinge member 50. Release handle 36 is pivotally attached, by a suitable pin 60, to two tabs 58 that are attached to mounting collar 48. Also mounted on pin 60 is a spring 62 which urges handle 36 toward filler neck 46. In the release handle shown, a cylindrical bearing member 64 is mounted in the upper section of release handle 36 by a suitable pin 66 so as to aid the latching engagement of handle 36 with tang 56.

Closure of the quick-release gas cap is accomplished by pressing cap 38 against the mouth of filler neck 48 so as to cause a spring loaded seal (not shown) carried by cap 38 to sealingly engage the mouth. Sufficient pressure is exerted to allow spring 62 to rotate handle 36 into a position placing cylinder 64 over tang 56. When the pressure to gas cap 38 is then released, the spring loaded seal both urges the seal against the filler mouth sealing the tank, and urges the tang 56 against cylinder 64 helping to maintain the release handle in position.

The cap may be opened by pressure either intentionally or accidentally applied to handle 36 in a direction away from gas cap 38. This causes cylinder 64 to roll off of tang 56 and allow the sealing spring to cause the cap to fly open.

The dimensions of the acute angle forming sections of clip 10 are chosen to matingly conform to the external configuration of hinge member 50. More specifically, the angle between clip sections 16 and 18 is chosen to conform generally to the shape of hinge section 50 and the width of sections 16 and 18 is chosen to be similar to that of hinge member 50 so as to permit clip 10 to fit between the hinge mounting tabs 52 as shown.

In order to secure the gas cap in its closed position, the latch retainer device is installed by first running the wing nut 44 out to near the end of stud 34 and then fitting clip 10 over the hinge member 50 between mounting tabs 52 so that clip section 20 extends vertically above the gas cap top. Next, the loop of body 12 is inserted over handle 36, and the wing nut 44 is run in on stud 34 so as to draw body 12 towards locking plate 10 and prevent handle 36 from disengaging the tang 56. With the latch retainer device so installed, the cap cannot be accidentally opened except by forces sufficient to deform either the latch retainer device or the handle 36.

Although it is contemplated that after having read the preceding disclosure certain alterations and modifications of the present invention will no doubt become apparent to those skilled in the art, it is intended that the following claims be interpreted to cover all such alterations and modifications as fall within the true spirit and scope of the invention.

What is claimed is:

1. A latch retainer device for securing a quick release gas cap means in its closed and locked position, such cap means being of the type including a cap which is rotatably attached to a tank filler neck by a hinge member and is releasably held in its closed position by a release handle that is pivotally attached to the filler neck and extends upwardly to engage a mating tang extending from the gas cap, said device comprising:

A clip means including a first generally flat section, a second generally flat section joined at one end at a first acute angle to an end of said first section to form a recessed portion, and a third generally flat section forming an upstanding portion, said third section being joined at one end to a midportion of said first section such that said recessed portion is adapted to matingly engage the cap hinge member; and an elongated latching body having one end adapted to engage the release handle and take-up means affixed to the opposite end for drawingly engaging said upstanding portion to prevent the release handle from rotating into its unlocked position.

2. A latch retainer device as recited in claim 1 wherein said upstanding portion of said clip means has an aperture formed therein; and said take-up means includes a threaded stud passing through said aperture and a threaded nut for engaging said stud and for drawing said body toward said clip means when said nut is run in on said stud.

3. A latch retainer device as recited in claim 1 wherein said body includes means forming a loop for receiving and engaging the distal end of the release handle.

4. A latch retainer device as recited in claim 1 wherein said upstanding portion of said clip means has an aperture formed therein; and said take-up means includes a threaded stud passing through said aperture and a threaded nut for engaging said stud and for drawing said body toward said clip means when said nut is run in on said stud.

* * * * *